United States Patent [19]

Lloyd

[11] 4,299,297

[45] Nov. 10, 1981

[54] ROTARY PERCUSSION BIT

[76] Inventor: Thomas C. Lloyd, R. D. #1, Box 327, Pittston, Pa. 18643

[21] Appl. No.: 46,075

[22] Filed: Jun. 6, 1979

[51] Int. Cl.[3] ..... E21B 9/36

[52] U.S. Cl. ..... 175/410; 175/415

[58] Field of Search ..... 175/53, 92, 95, 96, 175/105, 106, 389, 390, 409–420; 299/90

[56] References Cited

U.S. PATENT DOCUMENTS

| | | | |
|---|---|---|---|
| 473,479 | 4/1892 | Sharpneck et al. | 175/330 |
| 836,494 | 11/1906 | Frieh et al. | 175/96 |
| 884,150 | 4/1908 | Hardsocg | 175/330 |
| 972,666 | 10/1910 | Weston | 175/413 X |
| 1,388,490 | 8/1921 | Suman | 175/413 X |
| 2,371,490 | 3/1945 | Williams, Jr. | 175/329 |
| 2,750,156 | 6/1956 | Coates | 175/411 |
| 2,775,439 | 12/1956 | McCarthy | 175/53 |
| 2,976,027 | 3/1961 | Allimann | 175/106 X |
| 3,322,466 | 5/1979 | Mennekes | 175/106 X |
| 3,355,215 | 11/1967 | Haspert et al. | 299/90 X |
| 3,382,940 | 5/1968 | Stebley | 175/410 |
| 3,460,867 | 8/1969 | Cameron et al. | 175/53 X |
| 3,696,734 | 9/1972 | Richmond | 299/90 X |

*Primary Examiner*—James A. Leppink

*Attorney, Agent, or Firm*—Steele, Gould & Fried

[57] ABSTRACT

A rotary percussion bit comprising a shaft, a plate-like member secured to one end of the shaft, a plurality of relatively distributed, raised sections on one surface of the plate-like member, the raised sections containing a plurality of raised cutting elements, a plurality of projecting ribs around the rim of the plate-like member, and a plurality of exhaust holes through the plate-like member. The raised sections comprise rings projecting from the surface of the plate-like member and filler material disposed within the rings, the cutting elements being disposed in the filler material.

8 Claims, 3 Drawing Figures

FIG. 1.
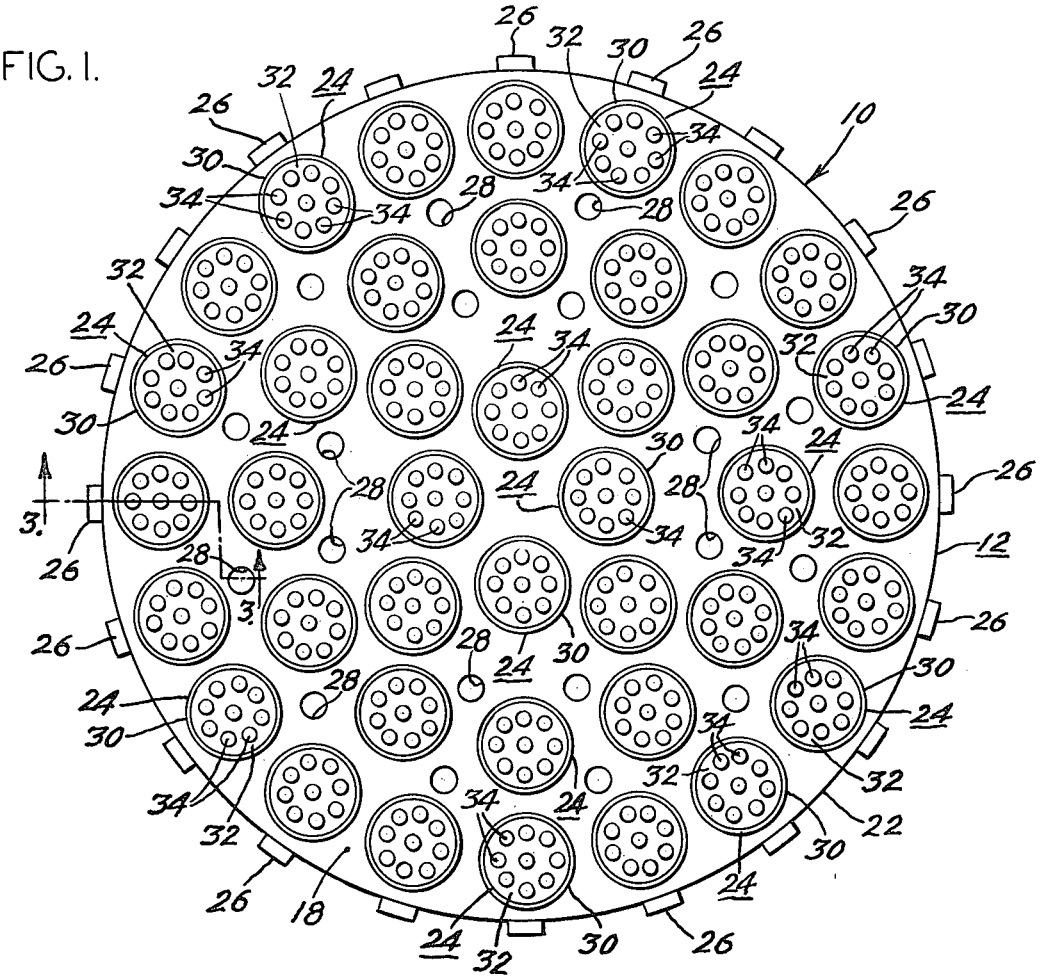
FIG. 2.
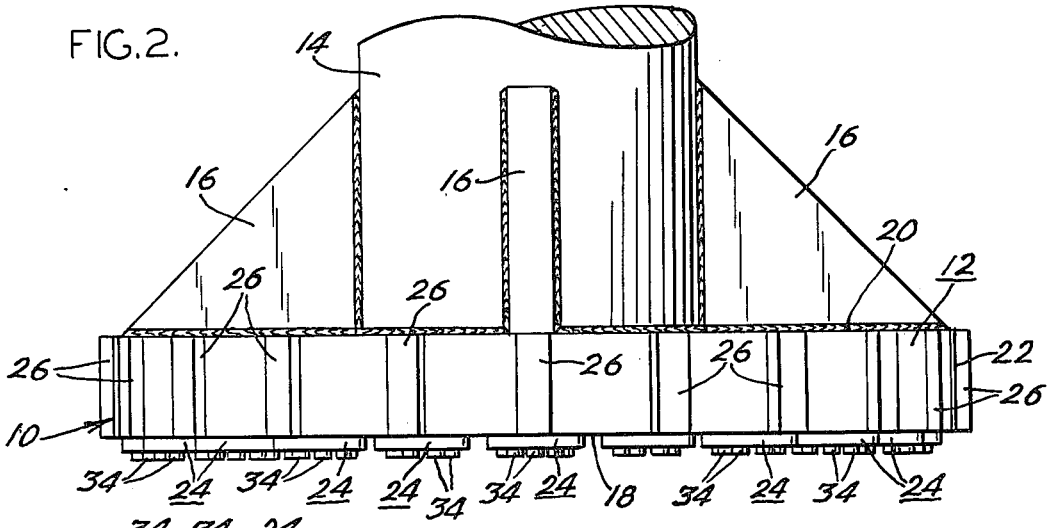
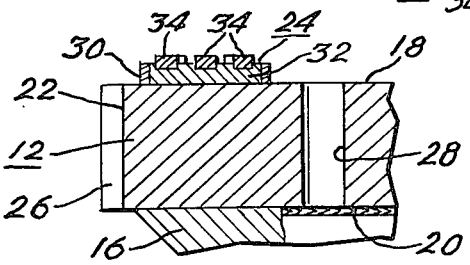
FIG. 3.

ROTARY PERCUSSION BIT

BACKGROUND OF THE INVENTION

1. Field of the Invention

This invention relates to the general field of bits for earth and rock drills, and in particular, to an improved rotary percussion bit.

2. Prior Art

Rock bits known in the art, particularly rotary percussion bits, are known to have particularly complex geometrical configurations which do not lend themselves to inexpensive or simple production. Some rock bits are also provided with means for replacing individual cutting elements which have become worn or broken through usage. With respect to the prior art, a rock bit according to this invention provides simple geometry, ease of construction and a relatively simple arrangement for replacing cutting elements.

The simple, but unique geometry of this invention is apparent from its basic structure, a round, plate-like member. All of the cutting elements are secured to a substantially flat surface. Although some bits are known in which cutting elements are mounted to a substantially flat surface, this invention is radically different with respect to the manner in which the cutting elements are mounted.

Cutting elements are frequently pressed or brazed into the bit. These are difficult to repair or replace by the nature of their attachment. Removable cutting element assemblies have been provided, such assemblies having a replaceable cutting element supported in a bit recess with a split sleeve. The recess has a space behind the sleeve and the cutting element with an anvil member located therein to prevent further penetration of the cutting element, but which enables the sleeve to be pushed further into the recess to release the cutting element when a force of sufficient magnitude is supplied thereto. Neither of these methods is particularly satisfactory. By way of contrast, a bit according to this invention is provided with a plurality of raised sections, relatively distributed on one surface of the basic plate-like member. These raised sections are formed from rings, which are secured to the surface of the plate-like member and filled with a filler material such as welding rod. A plurality of carbide cutting elements are mounted in each raised section of filler material. The surface of the plate-like member is therefore covered by a plurality of cutting elements disposed therein. Mounting the cutting elements in a filler material such as welding rod provides both secure attachment and a relatively easy means for replacing the cutting elements. No machining or press fitting is required. The bit is further provided with a plurality of air or exhaust holes and a plurality of projecting ribs mounted around the rim of the plate-like member.

With respect to ease of construction, no specially contoured, beveled or grooved shapes must be machined in order to produce a rock bit according to this invention.

SUMMARY OF THE INVENTION

It is an object of this invention to provide an improved rotary percussion earth and rock bit.

It is another object of this invention to provide a rotary percussion bit having a relatively simple geometrical configuration.

It is still another object of this invention to provide a rotary percussion bit wherein the replacement of cutting elements is facilitated.

It is yet another object of this invention to provide a rotary percussion bit wherein the cutting elements are disposed in a plurality of raised sections.

It is a further object of this invention to provide a rotary percussion bit wherein a plurality of raised sections are relatively distributed over one surface of a plate-like member, each of the raised sections having a plurality of cutting elements disposed therein.

It is a still further object of this invention to provide a rotary percussion drill wherein raised sections containing cutting elements are formed by rings holding a filler material.

These and other objects are accomplished by a rotary percussion bit, comprising a plate-like member and a plurality of relatively distributed, raised sections on one surface of the plate-like member, the raised sections containing raised cutting elements. The bit may further comprise a plurality of projecting ribs circumferentially mounted around the rim of the plate-like member and a plurality of air or exhaust holes through the plate-like member. The raised sections comprise rings projecting from the one surface of the plate-like member and filler material disposed within the rings. The cutting elements are disposed in the filler material, which may be welding rod. The bit is also provided with a shaft for rotationally and axially driving the bit.

BRIEF DESCRIPTION OF THE DRAWINGS

For the purpose of illustrating the invention, there are shown in the drawings forms which are presently preferred; it being understood, however, that this invention is not limited to the precise arrangements and instrumentality shown.

FIG. 1 is a bottom plan view of a rotary percussion bit in accordance with this invention;

FIG. 2 is a side view of FIG. 1; and,

FIG. 3 is an enlarged section view taken along the line 3—3 in FIG. 1.

DETAILED DESCRIPTION OF THE PREFERRED EMBODIMENTS

A rotary percussion bit 10 according to this invention, for drilling earth and rock, is shown in FIGS. 1 and 2. The principal structural member of bit 10 is plate-like member 12. Plate-like member 12 is preferably a circular steel plate formed of 1045 steel, approximately 3½" thick, and of a diameter approximately 1" less than the desired finished diameter of the hole to be bored. Plate-like member 12 may be driven by shaft 14, which is welded to both shaft 14 and surface 20. Preferably, there are four gussets 16, spaced 90° apart. The dimensions of the shaft 14 and gussets 16 will depend upon the overall size of the bit 10, but both shaft 14 and gusset 16 are preferably made of steel.

The other surface 18 of plate-like member 12, the lower surface with respect to the orientation of FIG. 2, is provided with a plurality of raised sections 24, relatively distributed over the entire surface or face 18 of the plate-like member. A plurality of cutting elements 34 are disposed in each raised section 24.

With reference to FIGS. 1 and 3, each raised section 24 is formed by a ring 30 which projects from surface 18, and which holds filler material 32. The filler material 32 holds the rings 30 on the plate-like member 12. The rings 30 may be steel, and the filler material may be welding rod, such as Certainium No. 706. The cutting elements 34 are preferably carbide cutting elements, such as Certainium No. 250 Hard Face. In the presently preferred embodiment, each ring 30 is approximately 3" in diamenter and projects approximately ½" above the surface 18. The rings 30 are filled with the filler material 32 to a level substantially even with their height. The cutting elements 34 are small rod-like elements, being approximately ½" in diameter and approximately ¼" in height. The cutting elements 34 are embedded in the filler material 32 to approximately one-half of their height. In the presently preferred embodiment, one cutting element 34 is placed in the center of each raised section 24 and is surrounded by a ring of cutting elements. It is presently preferred to utilize 7 to 9 cutting elements per raised section, but this number may vary in accordance with particular needs and applications. The raised sections 24 are distributed in such a manner that upon rotation of the bit 10, substantially the entire surface contacted by the bit 10 will be engaged by the cutting elements.

The bit 10 is also provided with a plurality of projecting ribs or raised sections 26, which project from the rim 22 of plate-like member 12. Projecting ribs 26 are as high as the thickness of plate-like member 12, and in the presently preferred embodiment, project approximately ½" out from the rim 22 and are approximately 1½" wide. Projecting ribs 26 may be formed from building up layers of welding rod and Hard Face by successive weld passes.

The bit 10 is further provided with a plurality of holes 28 through plate-like member 12 which serve as air flow or exhaust holes. It is presently preferred that the ratio of holes 29 to raised sections 24 be at least 1:3. The actual numbering may vary in accordance with the size of the bit and the amount of air pressure utilized to remove cuttings. The holes 28 may be randomly or relatively distributed among the raised sections 24, but, of course, must be located outside the circumference of the shaft 14 and not under any of the gussets 16.

A rotary percussion bit according to this invention has been found to be most effective to bore large diameter holes, up to 30" in diameter, to moderate depths, approximately 10 to 20 feet deep. The holes may be bored vertically into the earth, and no pilot bore is necessary.

The present invention may be embodied in other specific forms without departing from the spirit or essential attributes thereof, and accordingly, reference should be made to the appended claims, rather than to the foregoing specification as indicating the scope of the invention.

I claim:

1. A rotary percussion bit, comprising a plate-like member and a plurality of relatively distributed, raised sections on one surface of said plate-like member, said raised sections comprising a filler material in which are disposed raised cutting elements, all of said cutting elements forming a substantially planar cutting surface.

2. The bit of claim 1, further comprising a plurality of projecting ribs mounted around said plate-like member.

3. The bit of claim 1 or 2, further comprising a plurality of holes through said plate-like member.

4. A rotary percussion bit, comprising a plate-like member and a plurality of relatively distributed, raised sections on one surface of said plate-like member, said raised sections comprising rings projecting from said one surface and filler material disposed within said rings, said raised sections containing raised cutting elements.

5. The bit of claim 1, wherein said cutting elements are embedded in the filler material.

6. The bit of claims 1 or 4, wherein said one surface is substantially flat.

7. The bit of claims 1, or 4, wherein said cutting elements are carbide deposits.

8. The bit of claims 1 or 4, further comprising a shaft for rotationally and axially driving said bit, said shaft being secured to said plate-like member.

* * * * *